United States Patent [19]

McLoughlin

[11] Patent Number: 4,539,022

[45] Date of Patent: Sep. 3, 1985

[54] ROTATING DISK ELECTROSTATIC PRECIPITATOR WITH REMOVABLE UNIFORM FLOW DUCT

[75] Inventor: Joseph R. McLoughlin, Burnt Hills, N.Y.

[73] Assignee: General Electric Company, Schenectady, N.Y.

[21] Appl. No.: 595,202

[22] Filed: Mar. 30, 1984

[51] Int. Cl.[3] ..... B03C 3/10; B03C 3/47; B03C 3/76

[52] U.S. Cl. ..... 55/114; 55/121; 55/129; 55/143; 55/145; 55/146; 55/149; 55/150

[58] Field of Search ..... 55/113, 114, 121, 129, 55/141, 143, 145–147, 149, 150

[56] References Cited

U.S. PATENT DOCUMENTS

| | | | |
|---|---|---|---|
| 1,394,771 | 10/1921 | Kennard | 55/114 |
| 2,631,687 | 3/1953 | Dohrer | 55/114 |
| 3,606,531 | 9/1971 | Gourdine | 55/146 |
| 3,929,436 | 12/1975 | Kim et al. | 55/149 |
| 4,284,420 | 8/1981 | Borsyiak | 55/145 |

FOREIGN PATENT DOCUMENTS

| | | | |
|---|---|---|---|
| 713691 | 10/1931 | France | 55/114 |
| 359686 | 3/1962 | Switzerland | 55/121 |
| 344758 | 3/1931 | United Kingdom | 55/150 |
| 413800 | 7/1934 | United Kingdom | 55/150 |

*Primary Examiner*—David L. Lacey

*Attorney, Agent, or Firm*—Bernard J. Lacomis; James C. Davis, Jr.

[57] ABSTRACT

An electrostatic precipitator for removing particulate matter from a gas comprises at least two rotatable electrically conductive disks mounted on a shaft and disposed in an electrically insulating housing. There is further provided at least one substantially rectangular duct defining a flow path through the housing and between the rotating disks. The duct is preferably removable and provides a uniform flow path for the particulate laden gas. The precipitator configuration inhibits the formation of circular flow paths which tend to deposit particulate matter in undesirable locations as a result of centrifugal forces. The precipitator also includes a pair of wiper blades which are disposed outside of the duct and which operate to remove particulate matter from the disks so that it is deposited in a chute from which it is removed, by gravity, from the precipitator housing.

8 Claims, 8 Drawing Figures

ROTATING DISK ELECTROSTATIC PRECIPITATOR WITH REMOVABLE UNIFORM FLOW DUCT

BACKGROUND OF THE INVENTION

The present invention is generally directed to rotating disk electrostatic precipitators for removing particulate matter contained in a gas stream. More particularly, the present invention is related to a particular configuration and design for a rotating disk electrostatic precipitator which includes a removable duct which provides a uniform flow path for the gas between the rotating precipitator disks or plates.

There are many industries which generate flue gases or other gases which are laden with particulate matter. These industries include, for example, smelting, steel manufacture and electric power generation, particularly the geneeration of electric power from coal combustion. Many methods have been employed to remove this particulate matter from flue gases to prevent its being deposited in the atmosphere. One of the methods employed is that of electrostatic precipitation in which the dust laden gas is passed between high voltage electrodes. In general, such systems operate by imparting an electrical charge on the individual particles in the gas stream. The charged particles are then made to migrate to a collection surface by the action of an applied potential difference. While the aforementioned principles of operation. are fundamentally simple, there are many secondary factors which tend to complicate the process. For example, particle size and particle size distribution tend to play an important role in collection efficiency since particle mobility is largely dependent upon particle size. Similarly the travel distance between the point at which the particle is charged and the collecting surface is also important as is the gas flow velocity. Furthermore, the chemical and electrical nature of the dust itself is particularly important. For example, high resistivity dusts deposited on the collecting plates tends to increase the possibility of back corona discharge as a result of poor charge leakage to the collecting plate. Additionally, such dusts also create problems of flash over and reentrainment of the particulate matter in the gas stream. All of these phenomena negatively impact collection efficiency. In particular, the term collection efficiency refers to the amount of electrical energy which must be supplied to a precipitator system in order to remove a specified mass of particulate matter from the gas in which it is entrained.

At present, electrostatic precipitators of the kind contemplated herein are large structures. In a typical present day precipitator, dust is collected on a plurality of large vertical plates which are up to about 20 feet high and 20 feet long. These plates are rapped occasionally to cause the collected dust to drop off in clumps and fall to the bottom of the precipitator from which it is removed. The average dust layer on such plates may reach $\frac{1}{8}$ or even $\frac{1}{4}$ inch in thickness. As discussed above the presence of this dust layer is known to cause problems of reentrainment, back corona and flashover. However, experiments by the instant inventor have indicated that not only are these problems absent when the collection surfaces are kept clean, but, unexpectedly, the collection efficiency can be made as much as 10 to 20 times as high as it is when the surfaces are coated with even a very thin layer of dust. The reason for this phenomenon is not yet fully appreciated but it appears to be related to the greatly improved charge transfer that occurs when dust is collected on bare conducting surfaces. Accordingly, methods of continuously cleaning the collection surfaces is greatly desirable. More particularly, the present invention employs a rotating disk electrostatic precipitator design incorporating wiper means for continuously removing accumulated dust from the collecting disks. Even more particularly, the present invention provides an electrostatic precipitator configuration which includes a readily removable duct which operates to provide a uniform and controlled flow of gas through the precipitator itself.

Accordingly, the precipitator of the present design avoids the problems encountered in other designs employing rotating electrostatic precipitator disks. For example, U.S. Pat. No. 3,929,436 issued to Kim et al. on Dec. 30, 1975 discloses a rotating electrostatic precipitator design in which the particulate laden gas is seen to traverse an arcuate path. Such flow paths are unnecessarily inefficient in that flow velocity imparted to the gas in traversing the precipitator tends to impart a radially outward centrifugal force to the entrained particles thereby resulting in uneven particulate distribution, collection and deposition of particles on the outer walls of the precipitator. Similar centrifugal velocitites problems are also present in the precipitator design described in U.S. Pat. No. 2,631,687 issued Mar. 17, 1953 to F. J. Dohrer. However, the design of the precipitator of the present invention avoids these difficulties and at the same time provides a precipitator assembly which is capable of easy dissassembly for cleaning, servicing and replacement of wiper blades. Moreover, the precipitator design of the present invention may be easily ganged in a variety of series and parallel arrangements for optimal efficiency and particulate matter removal.

SUMMARY OF THE INVENTION

In accordance with a preferred embodiment of the present invention, an electrostatic precipitator for removing particulate matter from a gas in which such particulate matter is entrained comprises at least two rotatable electrically conductive disks mounted on a single shaft and separated to define a substantially cylindrical volume between the disks. A sealable electrically insulated housing surrounds the disks and includes at least one inlet port and at least one outlet port for supplying particulate laden gases to the precipitator. Most importantly, the precipitator includes at least one substantially rectangular duct extending between one of the inlet ports and one of the outlet ports so as to provide a uniform flow path from the inlet port to the outlet port between the rotatable disks. In particular, the duct is configured so that the disks form a portion of the side walls of the duct. At least one wire electrode is disposed so as to lie approximately between the disks, the electrode preferably, being attached to oppositely oriented duct walls. A pair of wiper blades is also disposed outside of the duct so as to remove particulate matter from the disks which then falls by gravity into a chute from which it is removed from the precipitator.

Accordingly, it is an object of the present invention to provide a rotating disk electrostatic precipitator having a uniform flowthrough velocity distribution.

It is also an object of the present invention to provide a rotating disk electrostatic precipitator configuration which is capable of easy disassembly for maintenance and replacement of wiper blades.

It is a still further object of the present invention to provide a clean disk electrostatic precipitator in which a minimum of particulate matter is permitted to accumulate on the collector disks before it is removed.

Lastly, but not limited hereto, it is an object of the present invention to provide an electrostatic precipitator which is readily ganged or mated with other precipitators of like design in various serial and parallel configurations.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 2:
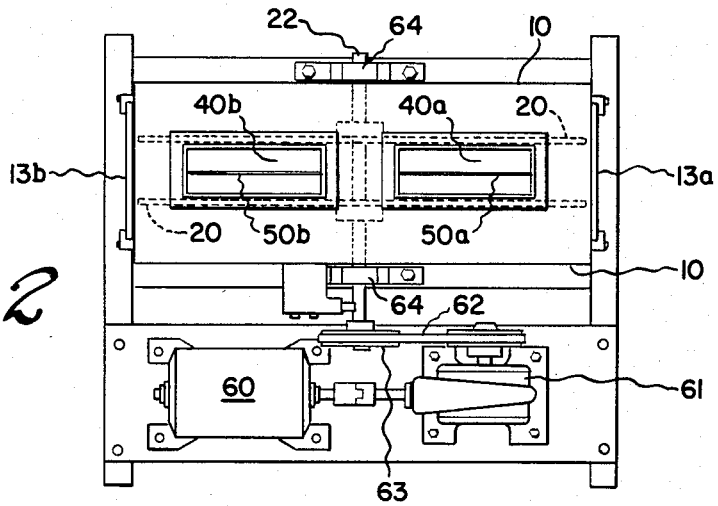
FIG. 2 is a top view of the device illustrated in FIG. 1, more particularly illustrating, in phantom, certain key internal components.
Figure 1:
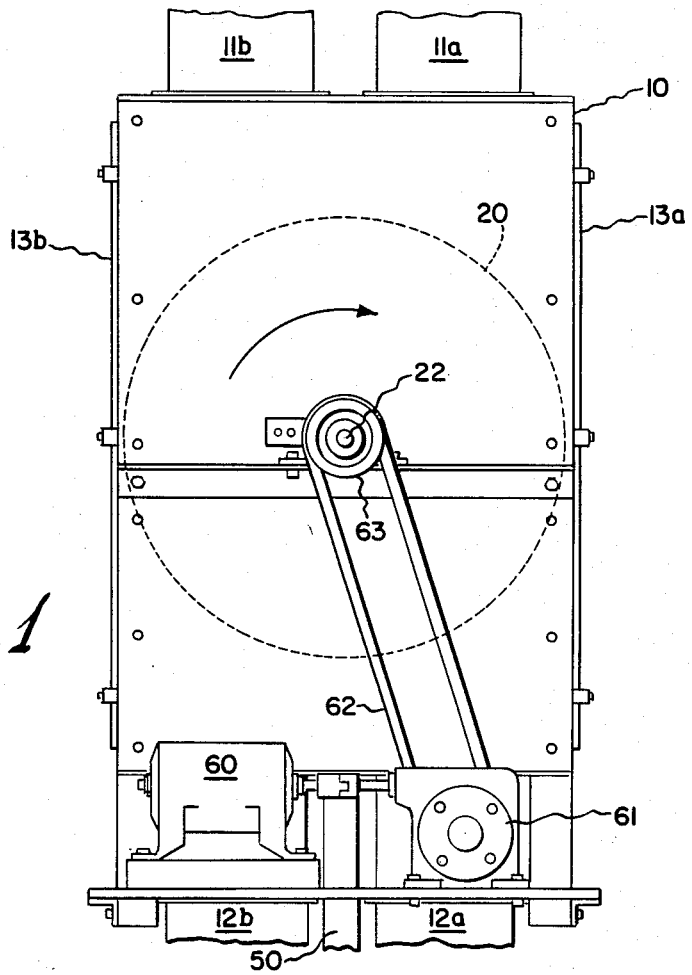
FIG. 1 is a side elevation view illustrating the exterior view of the housing, duct work and drive assemblies for an electrostatic precipitator in accordance with the present invention.
Figure 3:
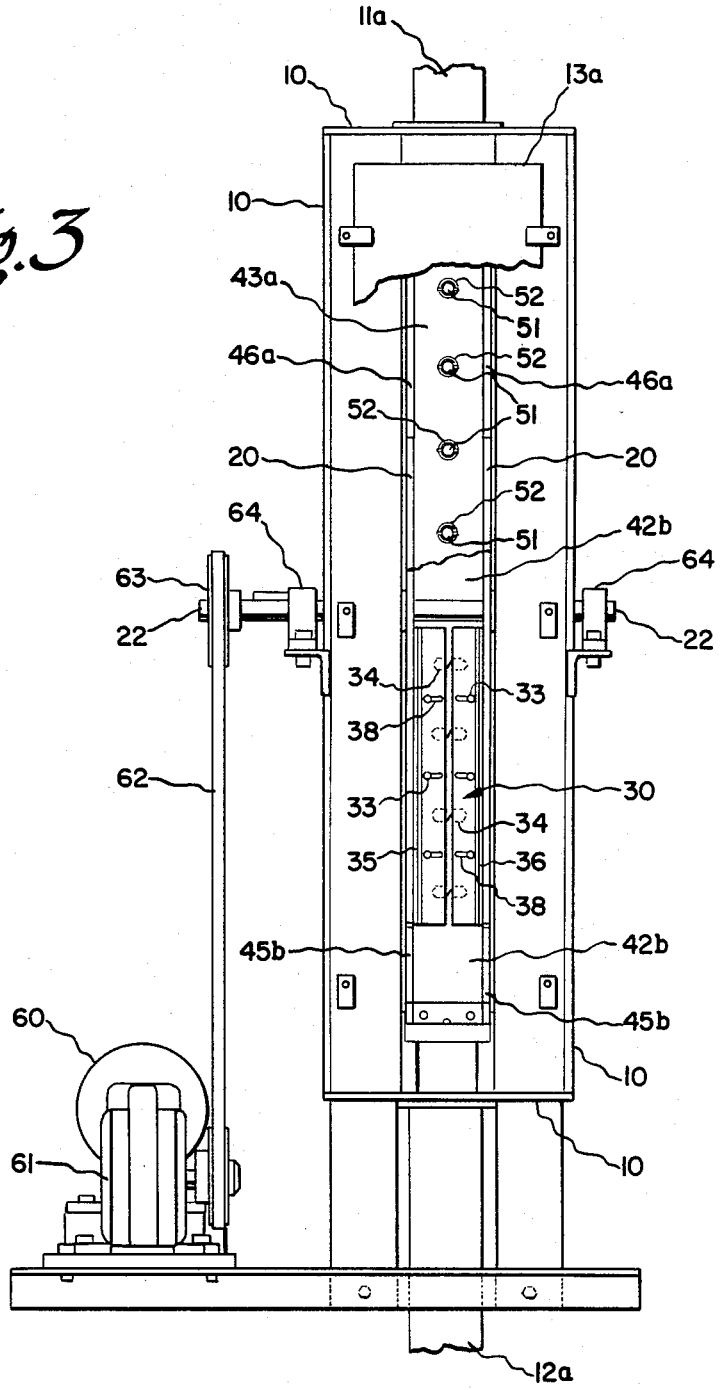
FIG. 3 is a partially broken away side elevation view of the apparatus shown in FIGS. 1 and 2.
Figure 4:
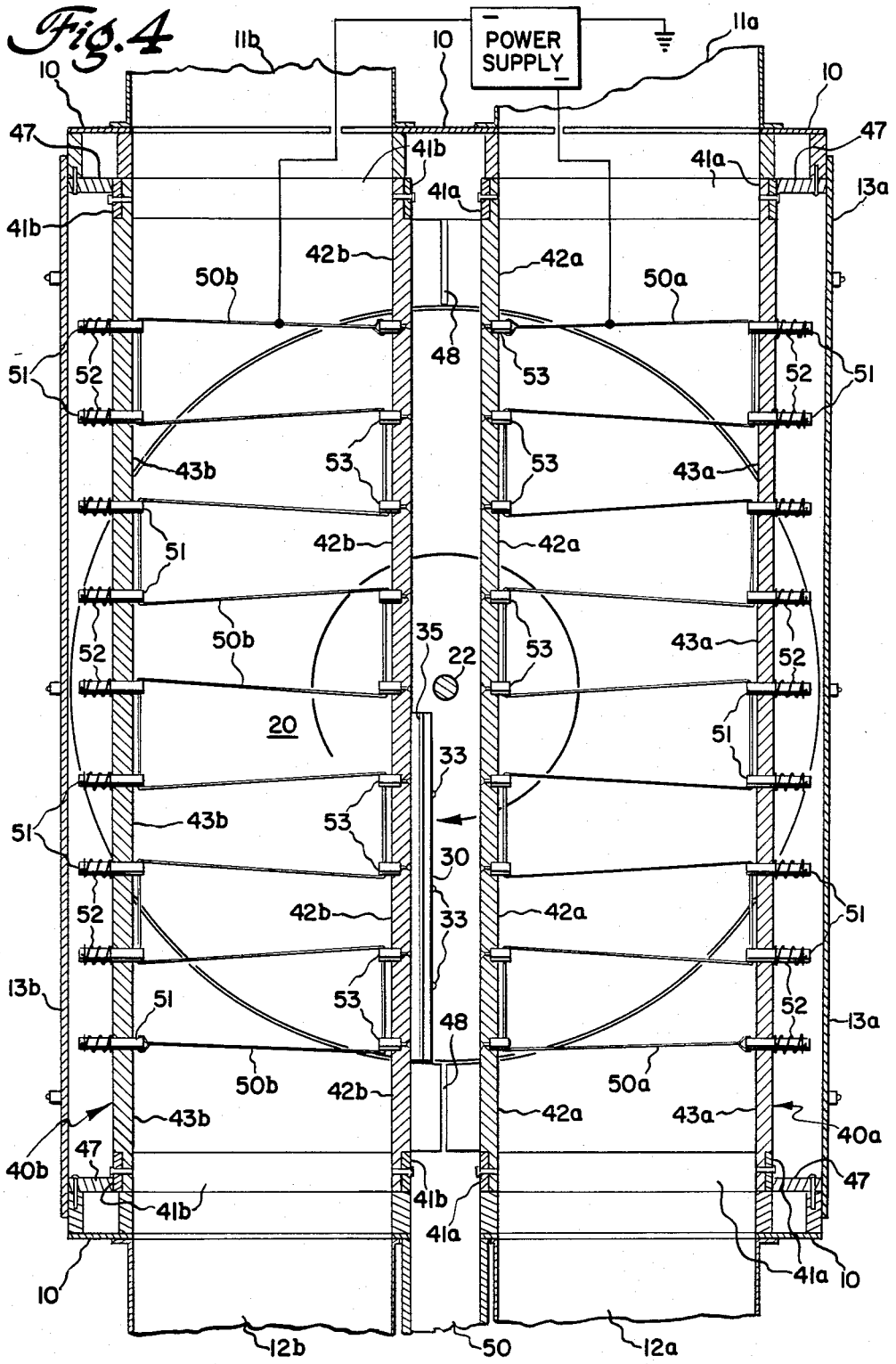
FIG. 4 is a partially cross-sectional side elevation view of the apparatus shown in FIGS. 1–3 which more particularly illustrates the configuration of one of the rotating disks and a pair of uniform flow ducts.

FIGS. 1–8 illustrate various features employed in a preferred embodiment of the present invention. In particular, FIGS. 1–3 are employed to illustrate the assembly and principle exterior features of the present invention. FIGS. 4–8 are employed to more particularly illustrate various internal features. FIG. 4 in particular, is employed to illustrate the removability of the uniform flow ducts which are employed.

Figure 5:
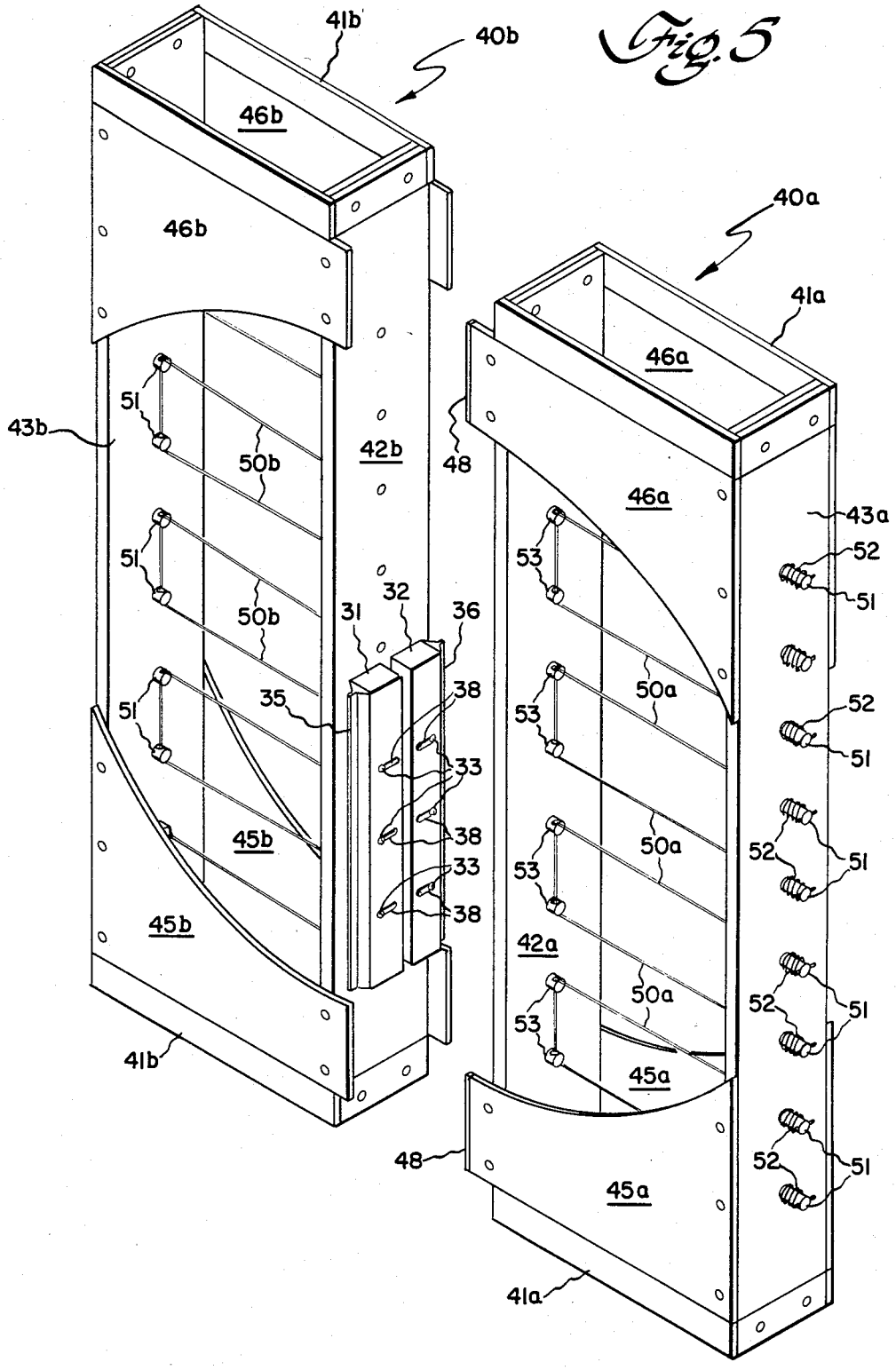
FIG. 5 is an isometric view illustrating a pair of uniform flow ducts employed in a preferred embodiment of the present invention.

FIG. 1 illustrates sealable housing 10 having a pair of inlet supply ducts 12*a* and 12*b* for feeding dust laden gas into the bottom region of the housing. Gas, from which a significant portion of particulate matter has been removed, exits housing 10 through exhaust ducts 11*a* and 11*b*. Ducts 11*a* and 12*a* for example, are configured so as to direct dust laden gases through an interior duct (40*a*, as seen in FIG. 5) in a uniform fashion. A similar relationship holds for ducts 12*b*, 11*b* and 40*b*. Inside housing 10 there are disposed a pair of rotating electrically conductive disks 20, one of which is seen in phantom view in FIG. 1. Rotating disks 20 are disposed on shaft 22 which is attached to pulley 63. Motor 60 drives gear reduction transmission 61 which in turn drives belt 62 which is seen disposed around pulley 63. In this fashion motor 60 drives rotating disks 20 at an appropriate rate of speed. As a result of the removability of interior ducts 40*a* and 40*b*, removable side wall sections 13*a* and 13*b* are provided as shown for interior access. The side walls are sealably fixed to housing 10 in any convenient manner. Also visible in FIG. 1 is a portion of chute 50 which is employed to remove particulate matter from the housing after it has been scraped from the rotating disks. Accordingly, it is seen that FIG. 1 provides a general overall exterior view of the electrostatic precipitator of the present invention. This view is further enhanced in FIG. 2 which provides a top view of the apparatus shown in FIG. 1. In particular FIG. 2 illustrates, in phantom, the presence of rotating disks 20. With respect to these disks, it is instructive to consider their direction of rotation as indicated by the arrow in FIG. 1 adjacent to pulley 63. More particularly FIG. 2 illustrates the use of support bearings 64 for rotating shafts 22 to which disks 20 are attached. Additionally, FIG. 2 also illustrates the relationship between uniform flow ducts 40*a* and 40*b* and rotating disks 20. Also shown, from a different perspective, are removable sidewall plates 13*a* and 13*b*. Removal of sidewall plates 13*a* and 13*b* permits removal of the pair of uniform interior flow ducts which are provided as an important aspect of the present invention and which are more particularly illustrated in detail in FIG. 5.

FIG. 3 also provides further appreciation of the exterior of the present precipitator. FIG. 3 provides a side view, and unlike FIGS. 1 and 2, is partially broken away so as to permit a partial view of the interior. In particular, only a portion of removable sidewall plate 13*a* is shown so as to permit a view of internal uniform flow duct 40*a*. However, only the upper portion of duct 40*a* is shown so as to permit a view of wiper assembly 30 which is affixed to an interior wall of duct 40*b* (see FIGS. 4–6). Other referenced structures (namely referenced elements 51 and 43*a*) are more appropriately described below in the context of the assemblies in which they are disposed.

FIG. 4 is a cross-sectional side elevation view of the apparatus of the present invention. In particular, for the sake of orientation the cross-sectional view presented in FIG. 4 is one taken from the motor side of the apparatus illustrated in FIGS. 1–3. FIG. 4 illustrates removable ducts 40*a* and 40*b* in their operative positions in the precipitator. However, for ease of understanding it is best to first consider FIG. 5 in which interior uniform flow ducts 40*a* and 40*b* are shown removed from the apparatus and oriented in a spaced apart position so as to more easily discern their various features.

Interior uniform flow ducts 40*a* and 40*b* are preferably constructed in an almost indentical fashion, apart from mirror image symmetry and the presence of wiper assembly 30 affixed to duct 40*b*. In particular, duct 40*a* includes top and bottom box frames 41*a*. Exterior duct wall member 43*a* is provided with a pair of lap joints to which box frames 41*a* are affixed. In a similar fashion, interior duct wall member 42*a* also includes lap joints to which box frames 41*a* are also affixed. In this fashion then, except for side walls, a rectangular parallelopiped shaped duct 40*a* is formed which includes a pair of box frames 41*a*, interior duct wall member 42*a* and exterior duct wall member 43*a*. The side walls for duct 40*a* are provided at least in part by rotating disks 20. Accordingly, side wall members 45*a* and 46*a* include arcuate edges as shown to accommodate the shape of the rotating disks. A similar structure is employed in the construction of uniform flow duct 40*b* which incorporates box frames 41*b*, interior duct wall member 42*b* and exterior duct wall member 43*b* along with side wall portions 45*b* and 46*b* each of which possess arcuate edges for the accommodation of rotating disks 20. Additionally, interior edges of side wall members 45*a* and 46*a* each include a strip of gasket material 48 to seal against a corresponding portion of side wall members 45*b* and 46*b* of duct 40*b*. Accordingly, four such gasketing strips are employed in the assembly illustrated in FIG. 5. FIG. 5 also illustrates wiper assembly 30 affixed to interior duct wall member 42*b* of duct 40*b*. A more detailed description of wiper assembly 30 is provided below in connection with the discussion of FIGS. 7 and 8.

Attention is now redirected to further consideration of FIG. 4. In particular, FIG. 4 illustrates the ease of removing ducts 40*a* and 40*b*, primarily for access to wiper assembly 30. For example, side wall plate 13*a* may be removed. After this, stop chocks 47 adjacent to duct 40*a* may be removed. Chocks 47 may be held in place by pins or screws as appropriate. However, once sidewall 13*a* and a pair of chocks 47 have been removed, the entirety of duct 40*a* is easily slid from housing 10. It is also instructive to consider the location of gasket material 48 seen also in FIG. 5. Likewise, FIG. 4 is also instructive in illustrating the direction of rotation of disks 20. It is therefore seen that, in operation, particulate matter which is attracted to disks 20 is ultimately brought into contact with wiper assembly 30 which removes the particulate matter from the rotating disk causing it to thereby fall, by gravity, into chute 50 through which it is removed from housing 10. Chute 50 may be directed to a collecting hopper or a moving conveyor belt or other particulate matter transport device.

Another important aspect of the present invention is also illustrated in FIG. 4. In particular, wire electrodes 50*a* and 50*b* are seen disposed in ducts 40*a* and 40*b* respectively. Wire electrodes 50*a* and 50*b* may comprise any convenient electrically conductive material, such as copper. The wire electrodes are preferably disposed in a position midway between rotating disks 20. In interior duct walls 42*a* and 42*b* studs 53 are provided with notches through which the wire electrode may be strung. In a similar fashion, in exterior duct walls 43*a* and 43*b* studs 51 are also provided with notches, (see FIG. 6) for the disposition therethrough of wire electrodes 50*a* and 50*b*. However, studs 51 are preferably provided with spring tensioning means 52 to prevent the wires from sagging, particularly under varying thermal conditions.

Figure 6:
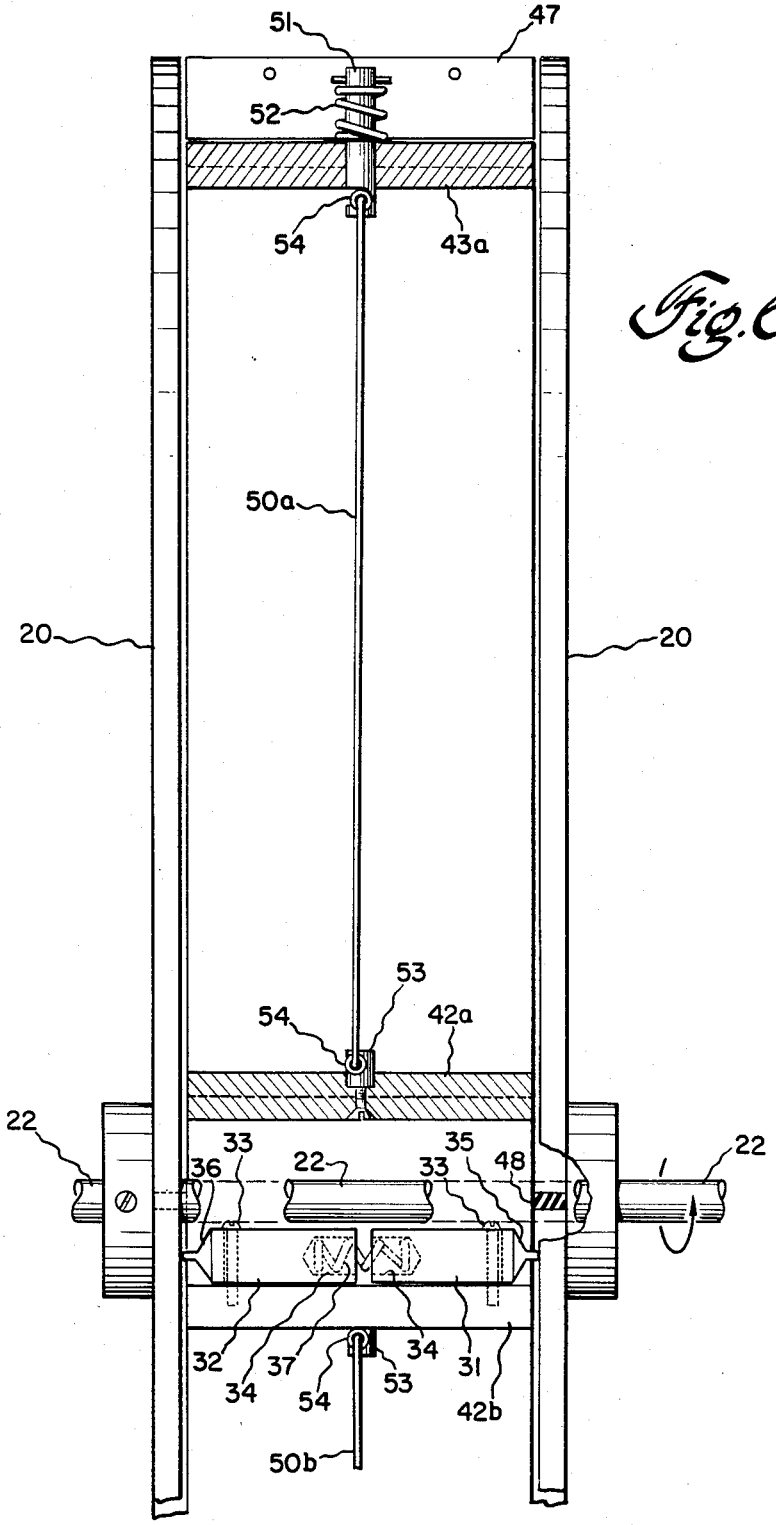
FIG. 6 is a partially cross-sectional top view which particularly illustrates one configuration of wire electrodes within the ducts.

A more detailed view of the wire electrode structure is provided in FIG. 6. In particular, it is seen that studs 53 and 51 include notches therein for holding wire electrodes 50*a* 50*b*. Additionally, cylindrical ceramic spacers 54 are also preferably included in the notches to provide additional electrical insulating and stress relief. Ceramic spacers 54 may be deleted if studs 53 and 51 comprise an insulating material such as a ceramic. Furthermore, depending upon the material and thickness employed in the construction of ducts 40*a* and 40*b*, more or less care should be taken with respect to the amount of tension provided by springs 52 so as not to cause wall members 42*a*, 43*a*, 42*b* and 43*b* to bow inwardly. FIG. 6 is a view looking down from the top of the apparatus shown in FIG. 1 so as to more particularly illustrate the disposition of wiper assembly 30 against a lower portion of interior duct wall member 42*b* of duct 40*b*. This positioning is consistent with the direction of rotation shown for disks 20. Aditionally, FIG. 6 is also noteworthy in that it provides a reasonably accurate representation of the clearances between various aspects of the present invention, particularly with rspect to the rotating disks. It is clear from FIG. 6 that interference clearances are not required. A space of approximately 1/16" may in fact be maintained between the rotating disks and vertical wall members 45*a*, 45*b*, 46*a* and 46*b* of ducts 40*a* and 40*b* without significantly impacting the operational effectiveness of the apparatus. Again, for purposes of orientation, the positioning of gasket material 48 may be noted.

Figure 8:
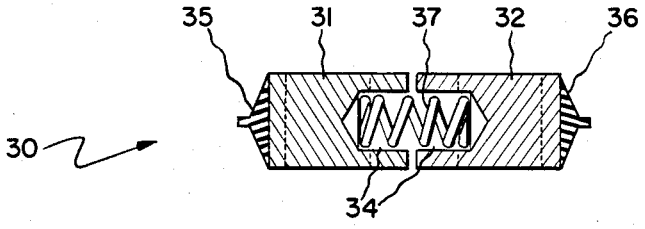
FIG. 8 is a top view of the wiper assembly shown in FIG. 7.
Figure 7:
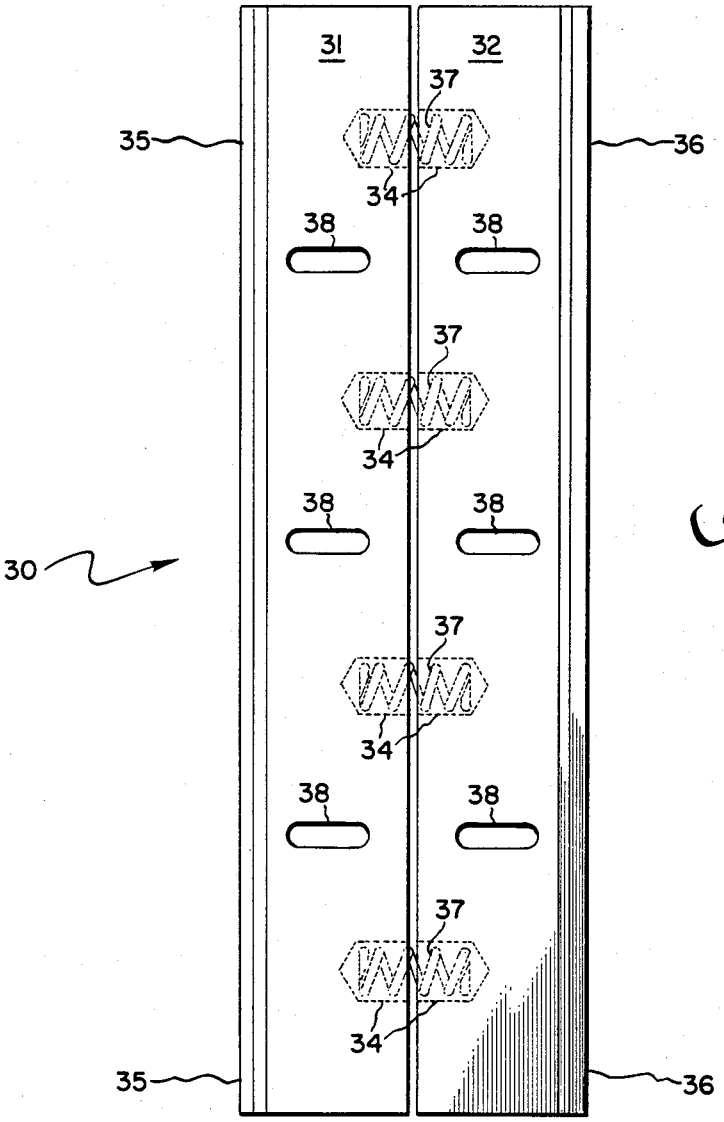
FIG. 7 is a front elevation view illustrating the construction of the wiper blade assembly employed to keep the rotating disks free of particulate matter.

FIGS. 7 and 8 illustrate the wiper assembly employed in the present invention. In particular, wiper assembly 30 comprises left member 31 and right member 32 which abut along an inner edge. In general, members 31 and 32 may actually comprise identical parts. On the outer edge of wiper assembly member 31 wiper blade 35 is affixed, for example, by adhesive means. Similarly, wiper blade 36 is affixed to right hand wiper assembly member 32. Members 31 and 32 each possess a plurality of apertures 34 drilled in their abutting faces so that springs 37 may be disposed in these apertures to provide a force which urges wiper blades 35 and 36 against disks 20. Wiper assembly members 31 and 32 also include slots 38. Screws 33 (see FIG. 6) are disposed in slots 38 so as to affix wiper assembly 30 to interior wall member 42*b* of duct 40*b*. A top view of this wiper assembly is seen in FIG. 8.

The apparatus of the present invention preferably comprises an electrically insulating material. Furthermore, in cases where the present invention is employed with hot gases, such as flue gas, it is desirable to employ heat resistant, electrically non-conductive materials. However, rotating disks 20 of the present invention comprise an electrically conductive material such as aluminum or mild steel. It is desirable that the rotating disks be as flat as practicable. The rotating disks must also be sufficiently stiff to resist vibration. It is also desirable that they comprise material which is harder than the material employed in the wiper blades. For example the wiper blades themselves may comprise material such as a stiff rubber or TEFLON®. The rotating disks should also be resistant to abrasion. Aluminum die plate has been found to be particularly flat and employable in electrostatic precipitators of the present invention, particularly where high abrasion resistance is not required. In terms of disk size, an 18" diameter disk is too small and a 20' disk is too large for most practical application. Moreover, in operation a 4 foot to 10 foot diameter disk is generally preferred for large scale commercial operations.

Wire electrodes 50*a* and 50*b* typically comprise an electrically conductive material such as copper. The wire electrode of the present invention may also be configured to comprise a length of wire exhibiting variable thickness. In particular, it is preferable that the wire electrode in the proximity of inlet ducts 12*a* and 12*b* comprise a smaller diameter wire enhances particle ionization at the gas inlet section and therefore provides increased collection efficiency.

It is also seen that in the present invention, the flow of particulate matter is essentially uniform in nature. The particulate laden gas is not forced to undergo passage through curved ducts within the precipitator. This enhances collection uniformity and efficiency. It is further seen that the internal precipitator ducts of the present invention are readily removable for access to the wiper blades. This facilitates changing of the wiper blades if they become worn, such as in the presence of abrasive particulate matter. Wiper assembly 30 is also seen to keep rotating metal disks 20 clear of accumulated particulate matter. As pointed out above, this also enhances collection efficiency, prevents back corona discharges, flashover and eliminates the necessity of rapping large area plates to collect the particulate matter.

Furthermore, it is seen that the precipitator of the present invention is quite compact in design and can process many cubic feet of air in a given period of time. This is indeed the most significant advantage of the present invention since it is no longer necessary to construct large buildings for particulate collection. The large 20 foot by 20 foot plate may be replaced by a single, much smaller diameter pair of rotating collecting disks. It is further seen that the flowpath through the region between the collector disks in the present invention is essentially straight. This is particularly important for high velocity flow since particulate matter is not urged to the outside of a curved flowpath by centrifugal forces. In other designs in which curved flowpaths are provided within the precipitator this effect can be significant since particulate matter tends to build up on areas other than the plates from which it can be readily removed. The compact size of the present invention even permits it to be installed directly in a chimney if necessary, particularly if high temperature insulating materials are employed. For example, high temperature composite phenolics including urea formaldehyde may be employed.

In operation, a negative voltage is applied to wire electrodes 50*a* and 50*b* via a conventional power supply 15, FIG. 4. The voltage applied is as high as possible without inducing breakdown. The electrically conducting rotating disks are then typically attached to an electrical ground. In operation, a voltage of 28 kilovolts may be employed for 20 mil electrode wire and a disks spacing of $2\frac{5}{8}''$. However, this voltage is in general a function of wire diameter and disks spacing; larger wire diameters and disks spacing generally require higher voltage. In particular, it is seen that the clean disks operation of the present invention permits use of higher voltages than would otherwise be employble. This has decidedly beneficial effects on collection efficiency which has been determined to be proportional to the square of the operating voltage. Accordingly, any improvement in this parameter permits an even greater improvement in collection efficiency. As indicated above, the wire size itself may be variable and the vertical spacing between the wires, that is between the studs, may also be adjusted to improve collection efficiency.

The compact nature of the present invention coupled with its uniform flow direction is particularly advantageous in permitting a plurality of devices such as are shown in FIGS. 1–3 to be coupled in series and parallel arrangements. For example, it is possible to gang a plurality of pairs of rotatable disks on a single shaft and to surround the plurality of disks with one housing. In such an arrangement, the exterior duct wall members for each pair of disks may also be mounted on a large box frame. In this case side wall members might only be necessary for the end disks. While the above description has emphasized the uniform and non-centrifugal nature of the flow through the ducts, it is also possible to provide a linear flow distribution which is greater nearer the shaft. Likewise, the output gas duct for the precipitator of the present invention may in turn be ducted into an adjacent precipitator which is optimized to operate on gases having less concentrated particulate matter, for example, by decreasing the spacing between the disks. The straightness of the flow path readily permits such systems to be constructed and operated at higher gas flow velocities than are possible with systems employing curved ducts.

From the above, it should therefore be appreciated that the electrostatic precipitator of the present invention provides advantages not heretofore achieved in the precipitator arts. In particular, the electrostatic precipitator of the present invention provides a uniform flow path, together with the advantages associated therewith as discussed above. The present invention also provides a precipitator construction configuration in which the uniform flow-through ducts are easily removed for service, maintenance and changing of the wiper blades and/or wiper blade assembly.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. An electrostatic precipitator for removing particulate matter from a gas containing such matter, said precipitator comprising:

at least two rotatable electrically conductive disks mounted on a single shaft and separated so as to define a substantially cylindrical volume therebetween;

a sealable, electrically insulated housing surrounding said at least two disks, said housing having at least one inlet port and at least one outlet port for supplying said particulate gases to said volume between said at least two disks;

at least one substantially rectangular cross section duct within said housing for providing flow communication of said gas between said at least one inlet port and said at least one outlet port, said at least one duct being configured so that said at least two disks form a portion of the side walls thereof, said at least one duct being constructed and arranged for movement as a unit into and out of said housing;

at least one wire electrode supported from said at least one duct so as to lie approximately midway between said at least two disks;

a pair of wiper blades disposed outside of said at least one duct, adjacent to said shaft and positioned and arranged for removing particulate matter on said at least two disks; and chute means for removal of said particulate matter scraped from said at least two disks by said wiper blades;

whereby the flow of gas through said precipitator is such as not to impart significant centrifugal velocities to said gas or to said particulate matter.

2. The precipitator of claim 1 in which said at least one duct includes end walls substantially orthogonal to said at least two disks and in which said at least one wire electrode is attached to said end walls.

3. The precipitation of claim 2 in which said at least one electrode wire varies in diameter so as to increase in said diameter from said at least one inlet port to said at least one outlet port.

4. The precipitator of claim 2 in which the at least one duct comprises two substantially rectangular ducts disposed on opposite sides of said shaft, each of said two substantially rectangular ducts having an opening in a sidewall thereof complementary to the shape of said at least two disks at portions juxtaposed thereto.

5. The precipitator of claim 1 further including means to apply a high voltage potential difference between said at least one wire electrode and said at least two rotatable disks.

6. An electrostatic precipitator for removing particulate matter from a gas containing such matter, said precipitator comprising:

a sealable, electrically insulated housing, said housing having at least one inlet port and at least one outlet port for passing said particulate gases therebetween;

at least two rotatable electrically conductive disks supported from said housing for rotation in the path of said gas;

at least one substantially rectangular cross section duct within said housing extending at least partly between said at least one inlet port and said at least one outlet port, so as to provide a flow path therethrough, said at least one duct being constructed and arranged for movement as a unit into and out of said housing, said at least one duct having opposite side walls with openings complementary to said at least two disks and configured to permit the location of said at least two disks within said openings to thereby form a portion of the side walls thereof when said at least one duct is inserted into said housing; and at least one wire electrode supported by said at least one duct, so as to lie between said at least two disks;

whereby the flow of gas through said precipitator is such as not to impart significant centrifugal velocities to said gas or to said particulate matter.

7. The precipitator recited in claim 6 further including a pair of wiper blades supported by said at least one duct adjacent to said shaft and positioned and arranged for removing particulate matter on said at least two disks.

8. The precipitator recited in claim 7 further including chute means for removal of said particulate matter scraped from said at least two disks by said wiper blades.

* * * * *